US010476121B2

(12) United States Patent
Leray et al.

(10) Patent No.: US 10,476,121 B2
(45) Date of Patent: Nov. 12, 2019

(54) FILTERING DEVICE AND FILTERING ASSEMBLY HAVING AN ELECTRICALLY CONDUCTING STRIP STRUCTURE

(71) Applicants: TIME REVERSAL COMMUNICATIONS, Cergy Pontoise (FR); CENTRE NATIONAL DE LA RECHERCHE SCIENTIFIQUE, Paris (FR)

(72) Inventors: Christian Leray, Courdimanche (FR); Geoffroy Lerosey, Paris (FR); Nadège Kaina, Fresnes (FR)

(73) Assignees: AVANTIX, Aix-en-Provence (FR); CENTRE NATIONAL DE LA RECHERCHE SCIENTIFIQUE, Paris (FR)

( * ) Notice: Subject to any disclaimer, the term of this patent is extended or adjusted under 35 U.S.C. 154(b) by 43 days.

(21) Appl. No.: 15/529,850

(22) PCT Filed: Nov. 26, 2015

(86) PCT No.: PCT/FR2015/053224
§ 371 (c)(1),
(2) Date: May 25, 2017

(87) PCT Pub. No.: WO2016/083747
PCT Pub. Date: Jun. 2, 2016

(65) Prior Publication Data

US 2017/0263993 A1 Sep. 14, 2017

(30) Foreign Application Priority Data

Nov. 27, 2014 (FR) ..... 14 61555

(51) Int. Cl.
*H01P 1/203* (2006.01)
*H01P 7/08* (2006.01)
*H01P 5/12* (2006.01)

(52) U.S. Cl.
CPC ..... *H01P 1/203* (2013.01); *H01P 1/20336* (2013.01); *H01P 7/082* (2013.01); *H01P 7/088* (2013.01); *H01P 5/12* (2013.01)

(58) Field of Classification Search
CPC .. H01P 1/203; H01P 1/20327; H01P 1/20336; H01P 1/20363; H01P 1/20354; H01P 7/08; H01P 7/082; H01P 7/088
(Continued)

(56) References Cited

U.S. PATENT DOCUMENTS 3,875,538 A 4/1975 Minet et al.
3,959,749 A * 5/1976 Ikushima ..... H01P 1/203 333/203

(Continued)

FOREIGN PATENT DOCUMENTS

GB 2 332 785 A 6/1999

OTHER PUBLICATIONS

International Search Report as issued in International Patent Application No. PCT/FR2015/053224, dated Feb. 4, 2016.

(Continued)

*Primary Examiner* — Stephen E. Jones
(74) *Attorney, Agent, or Firm* — Pillsbury Winthrop Shaw Pittman LLP

(57) ABSTRACT

A filter device includes a transmission line formed by an electrically conducting strip printed on a surface of an electrically insulating substrate, the conducting strip having two ends respectively forming the two sole input and output connection ports of the filter device, and a plurality of resonators, each resonator including an electrically conduct- (Continued)

Figure 1:
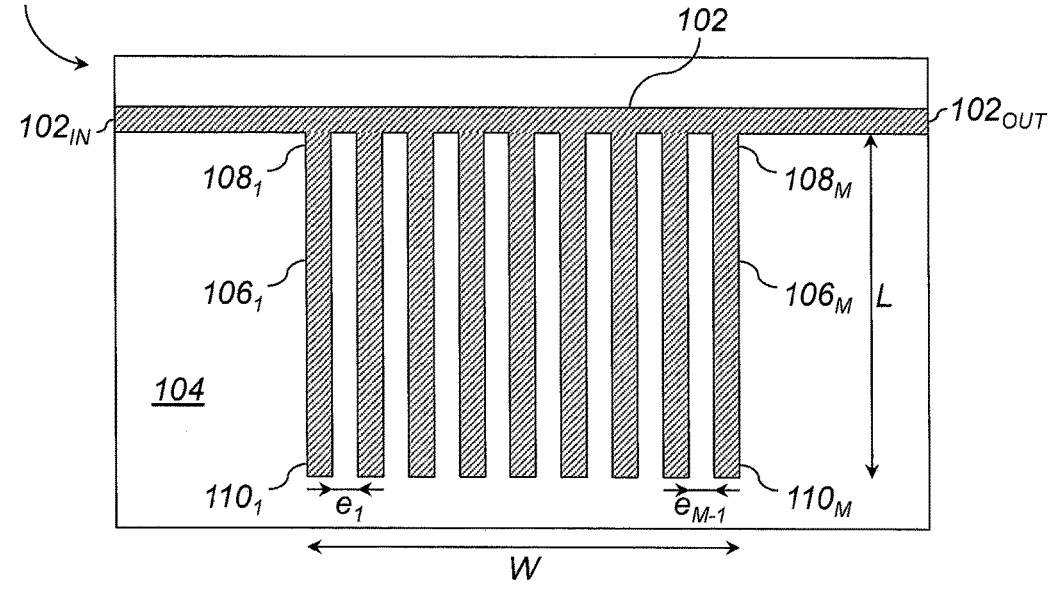

ing strip printed on the surface of the substrate. The conducting strip of each resonator has a first end coupled to the transmission line and at least one second end that is free or connected to a ground so as to create an effective fundamental resonant wavelength specific to each resonator. For each pair of neighboring resonators of the plurality of resonators, the distance between the first ends of the two neighboring resonators is less than one tenth of the smallest effective fundamental resonant wavelength of the plurality of resonators.

10 Claims, 8 Drawing Sheets

(58) Field of Classification Search
USPC ..... 333/204, 205, 33
See application file for complete search history.

(56) References Cited

U.S. PATENT DOCUMENTS 6,504,448 B1 * 1/2003 Yip ..... H01P 5/04 333/263
2010/0141356 A1 * 6/2010 Uhm ..... H01P 1/20336 333/203

OTHER PUBLICATIONS

Hong, J.-S., "Microstrip Filters for RF Microwave Applications," Second edition, published by Wiley, 2011, 655 pages.
Hunter, I. C., et al., "Varactor Tuned Microwave Filters," IEEE Microwave Symposium Digest, Jun. 1982, XP031667366, pp. 399-401.

* cited by examiner

FILTERING DEVICE AND FILTERING ASSEMBLY HAVING AN ELECTRICALLY CONDUCTING STRIP STRUCTURE

CROSS-REFERENCE TO RELATED APPLICATIONS

This application is the U.S. National Stage of PCT/FR2015/053224, filed Nov. 26, 2015, which in turn claims priority to French patent application number 1461555 filed Nov. 27, 2014. The content of these applications are incorporated herein by reference in their entireties.

This invention relates to a filter device with an electrically conducting strip structure. It also relates to a filtering assembly comprising multiple filter devices of this type.

This invention more particularly applies to a filter device with an electrically conducting strip structure, comprising:

- a transmission line formed by an electrically conducting strip printed on a surface of an electrically insulating substrate, this conducting strip having two ends respectively forming the two sole input and output connection ports of the filter device, and
- a plurality of resonators, each resonator comprising an electrically conducting strip printed on said surface of the substrate.

Numerous different configurations of electromagnetic filter devices can be produced using microstrip technology, in particular to design radiofrequency high-order filters. According to this technology, a filter device is produced using electrically conducting strips printed by simple engraving on a surface of an electrically insulating substrate. One or more ground planes can also be produced on the same surface of the substrate, or on another surface of the substrate, or by stacking substrates.

Most filter devices printed with microstrip technology use a qualified "distributed constants" filtering technique according to which discrete component assemblies are replaced with unit cell assemblies with electrically conducting printed strips, each unit cell performing a predetermined function R, L and/or C. According to this technique, the unit cells are sufficiently distant from each other so as not to interfere with each other. Furthermore, in order to obtain high-order filter devices, the number of filter devices connected via a serial connection is multiplied. This results in filters with large, sometimes disadvantageous volumes, which increase progressively with the filter order, taking into account the frequencies targeted (those of the radiofrequency spectrum up to 300 GHz) and the applications considered.

Furthermore, in the field of transmission line filter devices using microstrip technology as can be illustrated by the works of Jia-Sheng Hong, entitled "Microstrip filters for RF microwave applications—Second edition", published by Wiley in 2011, at a given operating frequency, one of ordinary skill in the art is generally guided by the objective of obtaining an impedance delay line and therefore significant dephasing with discrete values, i.e. $\pi$ or $\pi/2$, which involves deviations between neighbouring resonators greater than or equal to $\lambda/2$ or $\lambda/4$. In an exceptional manner, the patent document U.S. Pat. No. 3,875,538 presents an approach consisting of trying to obtain a delay line having a dephasing of $\pi/4$, which involves deviations between neighbouring resonators of around $\pi/8$. However below this unusual dephasing value, the delay line would have an impedance that is too low, which is never desirable.

There is therefore a desire to design a filter device with an electrically conducting strip structure that overcomes at least part of the aforementioned problems and restrictions.

It is therefore proposed a filter device with an electrically conducting strip structure of the aforementioned type, wherein:

- the conducting strip of each resonator has a first end coupled to the transmission line between the two connection ports and at least one second end that is free or connected to a ground so as to create an effective fundamental resonant wavelength specific to each resonator on said surface of the substrate, and
- for each pair of neighbouring resonators of the plurality of resonators, the distance between the first ends of two neighbouring resonators of this pair is less than one tenth of the smallest effective fundamental resonant wavelength of the plurality of resonators on said surface of the substrate.

The "effective fundamental resonant wavelength" of a resonator is of course understood as the wavelength effectively produced on said surface of the substrate by the fundamental resonance of the resonator considered, this wavelength being different from what it would be in air because the refractive index of the substrate is not equal to that of air.

The term "first end coupled to the transmission line" is understood as being either a connection of said first end to the transmission line, or potentially a capacitive coupling by moving said first end and the transmission line closer together.

The layout thus proposed results in a metamaterial structure obtained by microstrip technology, which has particularly surprising and advantageous properties. Firstly, by moving the resonators sufficiently close to each other so that the distances between the first ends of neighbouring resonators are less than one tenth of the smallest effective fundamental resonant wavelength of the plurality of resonators, a very compact and minimum-volume filter device is obtained for a given operating frequency band. The compact filter device obtained then has a high-order band-stop transfer function, in particular thanks to the hybridisation band gap property of the metamaterials acting in the radiofrequency spectrum. Finally, a reduction in group velocity is also observed for all electric signals passing through the filter device, which enables such a device to be considered as an alternative to the low-speed transmission lines that are generally very complex with their microstrip technology. It should finally be noted that, unlike the teachings of the aforementioned prior art, the invention relates to a device that is not designed to include a delay line, whose impedance or dephasing is considered. The main aim is to obtain a metamaterial effect from resonators coupled to a transmission line that is as short as possible, regardless of its impedance, which thus becomes negligible and not taken into consideration.

Optionally, the conducting strips forming the transmission line and the resonators are rectilinear, the resonators also being parallel to each other so as to form a resonator comb.

Also optionally, the resonators are perpendicular to the transmission line.

Also optionally, the resonators all have the same nominal length, so as to produce the same nominal effective fundamental resonant wavelength, with the exception of at least one short resonator, each short resonator being surrounded by two neighbouring resonators of nominal length and having a length that is less than the nominal length so as to produce at least one resonant cavity in said plurality of resonators.

For example, the resonators all have a nominal length except for a single short resonator so as to produce a single resonant cavity in said plurality of resonators.

In another example, the resonators all have a nominal length except for N short resonators, where N≥2, positioned according to a periodic pattern so as to produce N resonant cavities periodically distributed in said plurality of resonators.

Also optionally, at least one resonator is equipped with an electronic component for adjusting its fundamental resonance equivalent electrical frequency.

Also optionally, the electronic adjustment component comprises one of the elements of the set consisting of a PIN diode, a varicap diode, a varistor and a transistor.

It is also proposed a filtering assembly with at least one input connection port and at least one output connection port, comprising a plurality of filter devices according to the invention, wherein:

- the electrically conducting strips forming the transmission lines and the resonators of the filter devices are printed on the same surface of the same substrate,
- the filter devices are coupled to each other in series and/or in parallel.

Optionally, a filtering assembly according to the invention can comprise a single input connection port and a single output connection port, the filter devices being coupled to each other via a series connection such that the input connection port of the first filter device of the series forms the input connection port of the filtering assembly and the output connection port of the last filter device of the series forms the output connection port of the filtering assembly.

Figure 2:
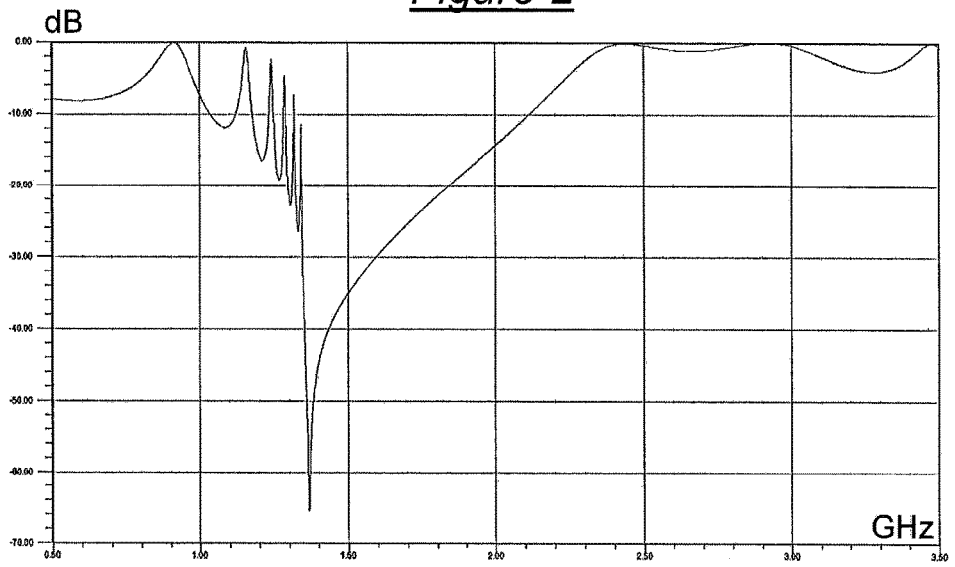
Figure 3:
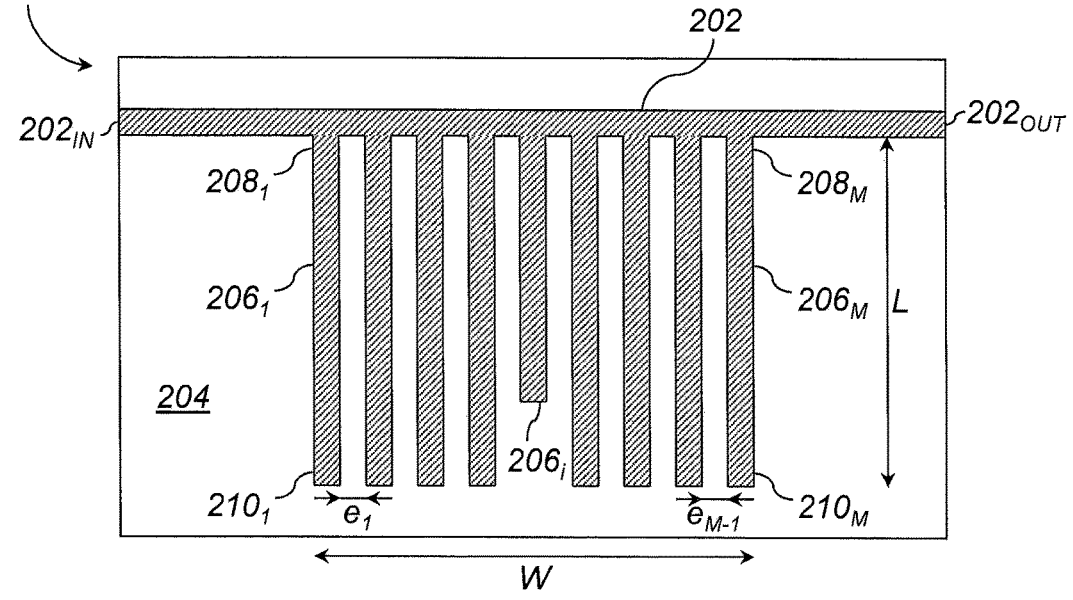
Figure 4:
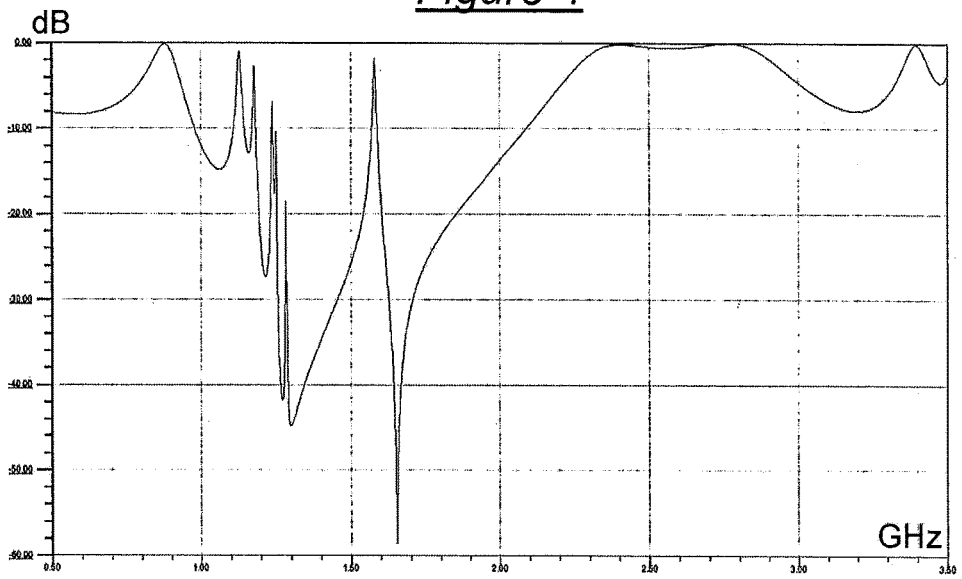
Figure 5:
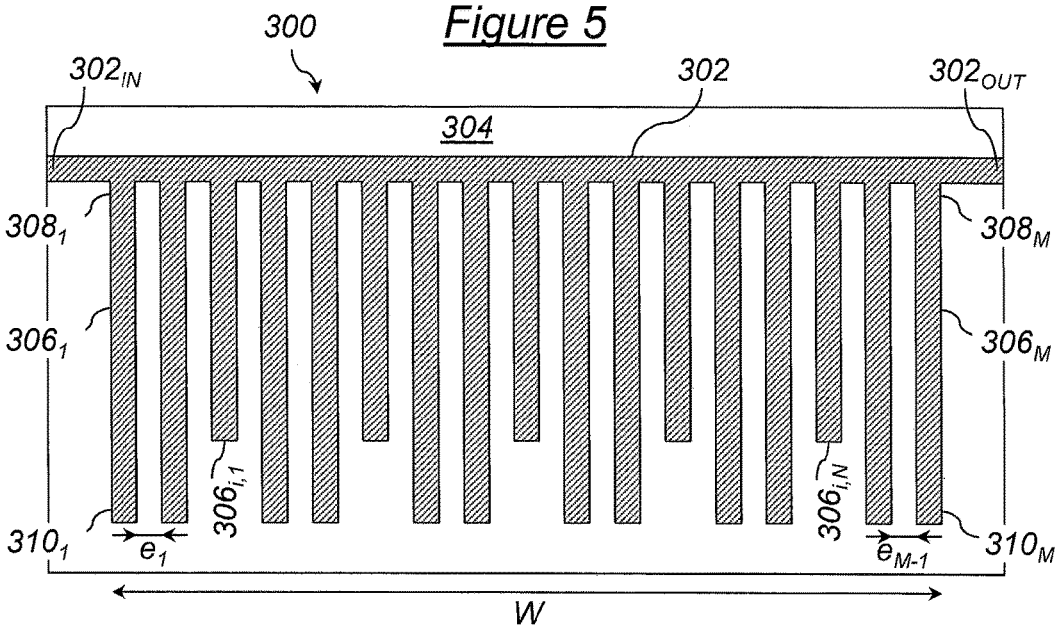
Figure 6:
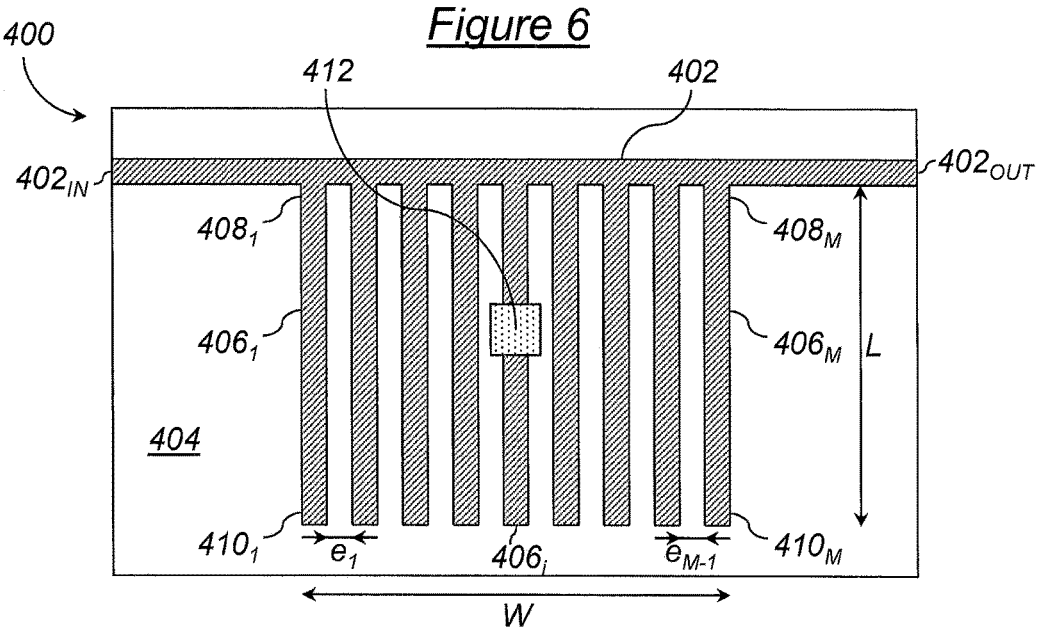
Figure 7:
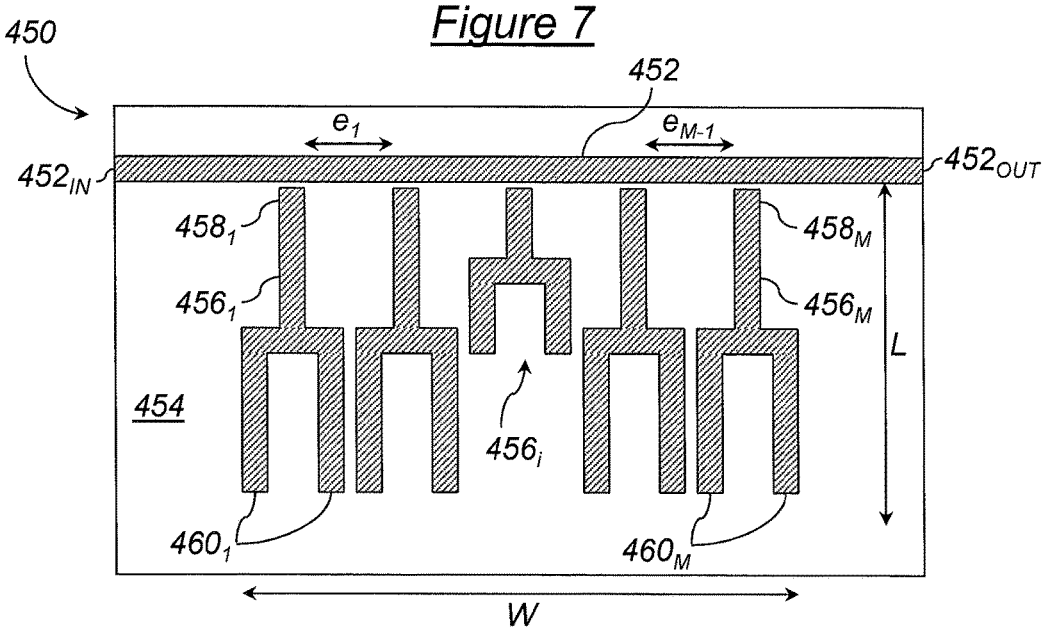
Figure 8:
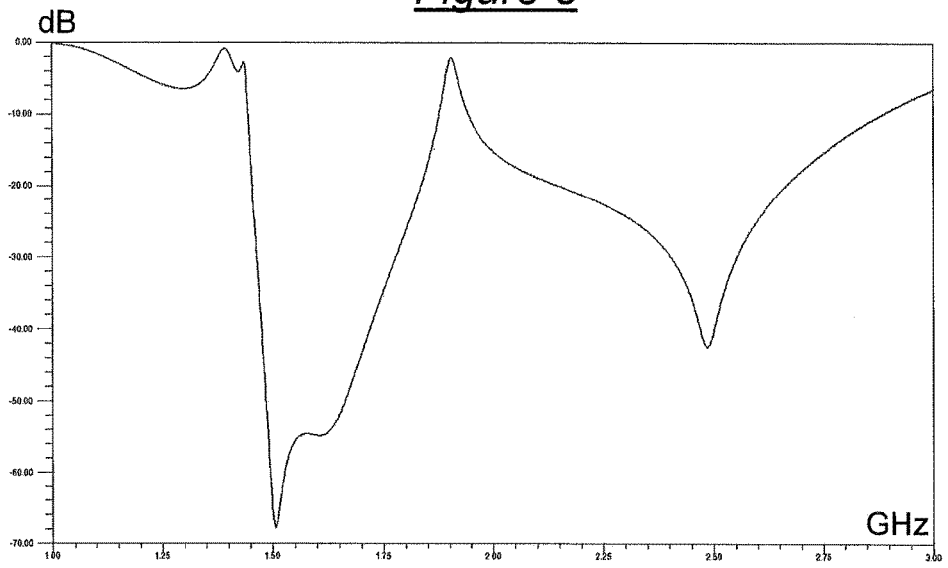
Figure 9:
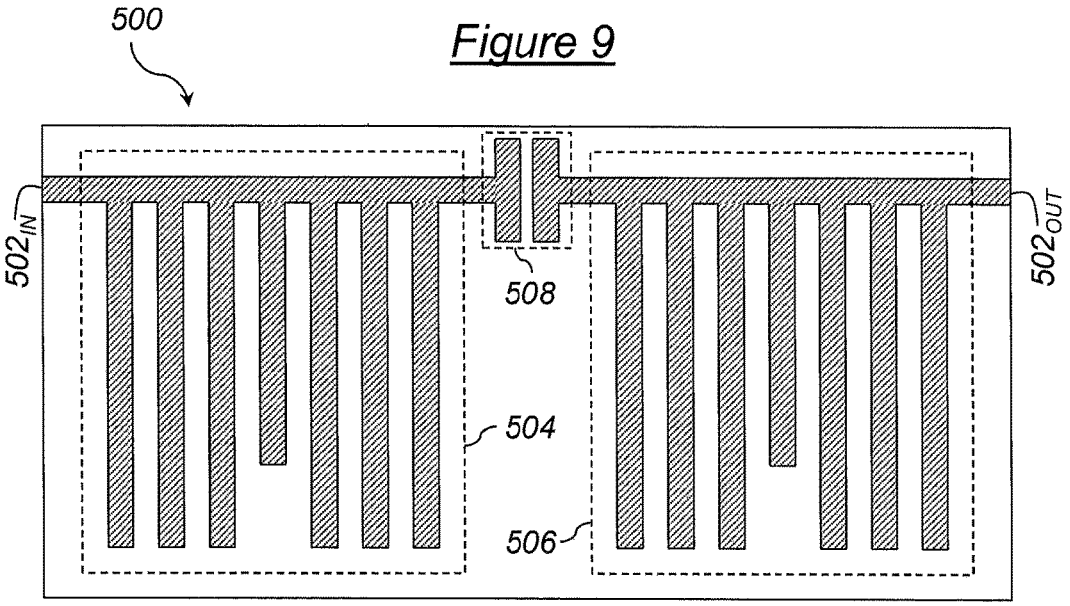
Figure 10:
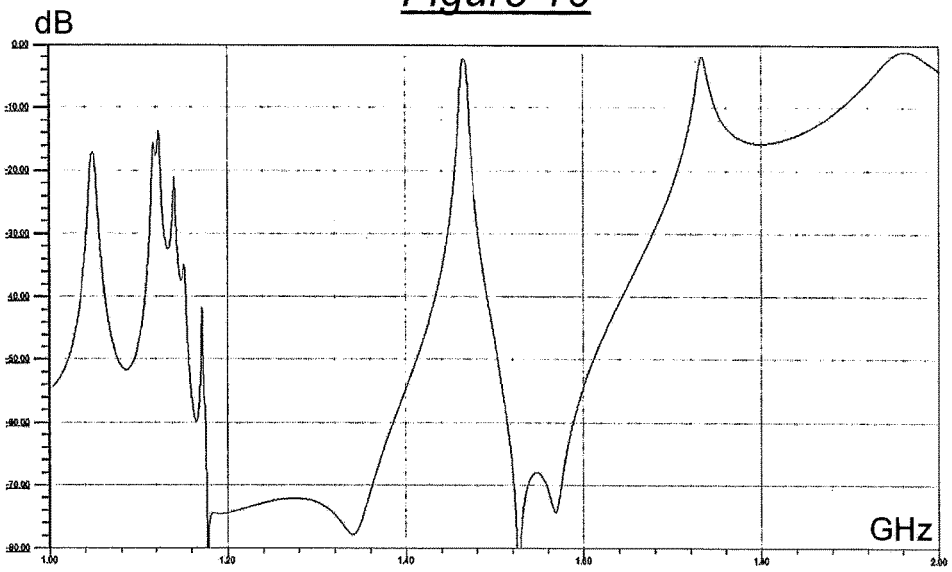
Figure 11:
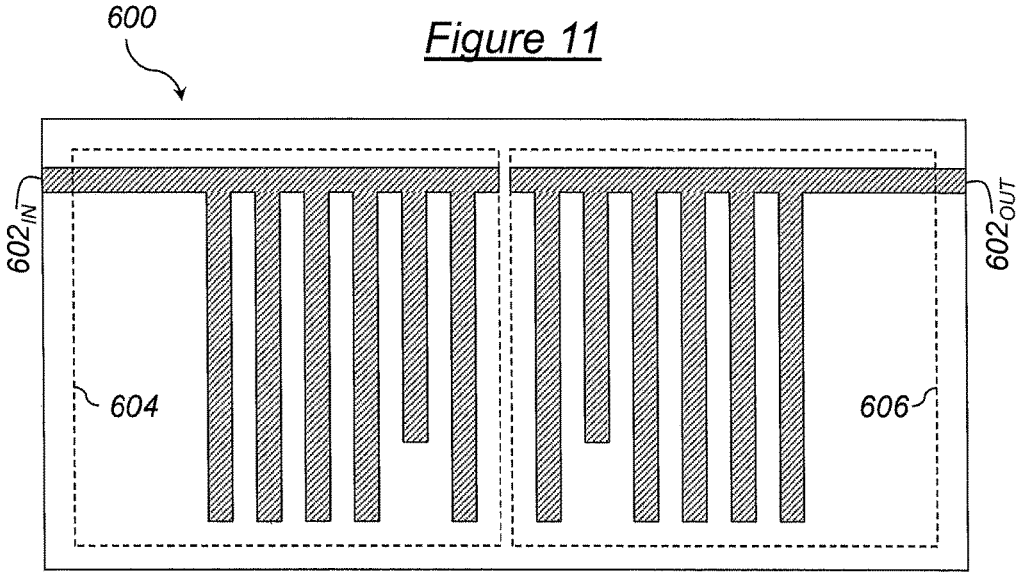
Figure 12:
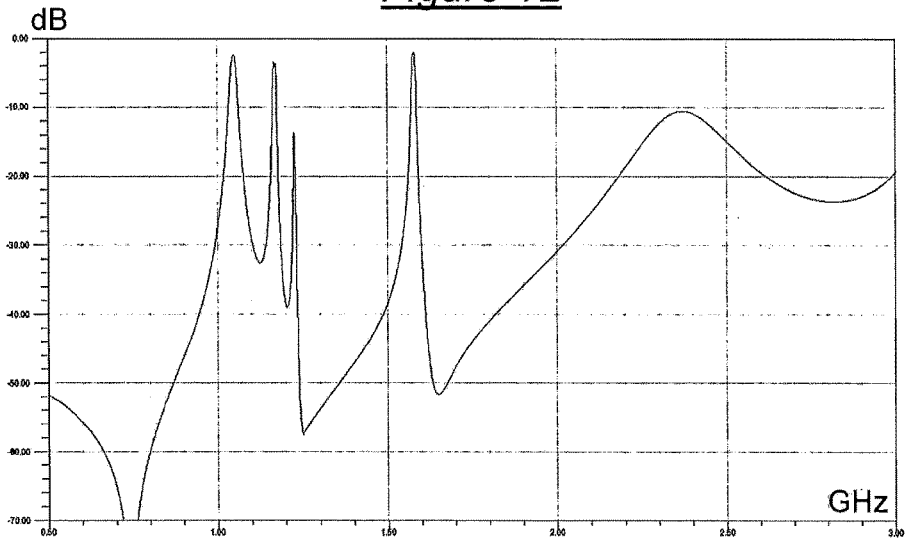
Figure 13:
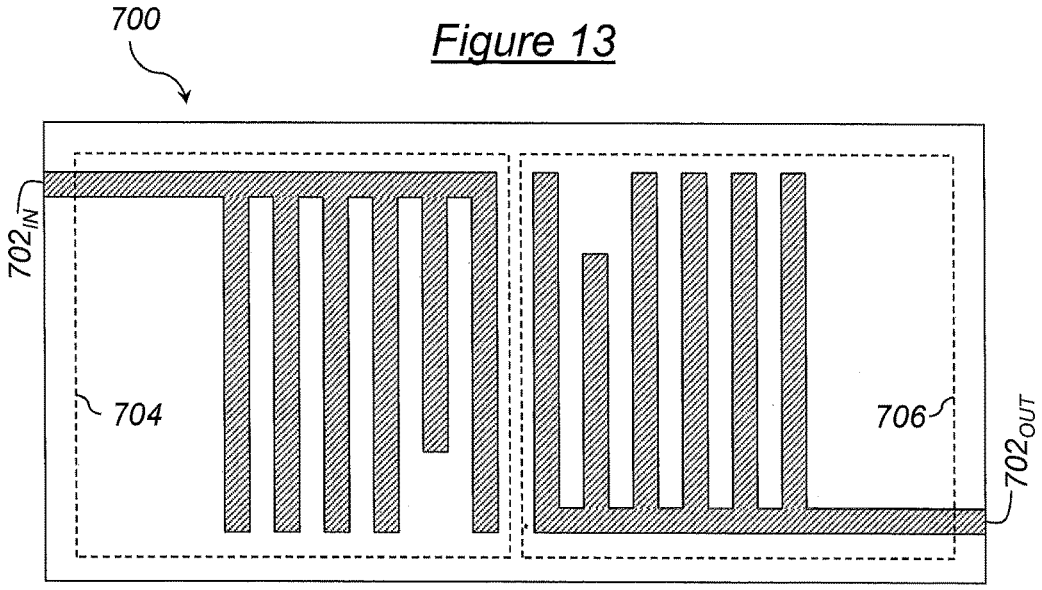
Figure 14:
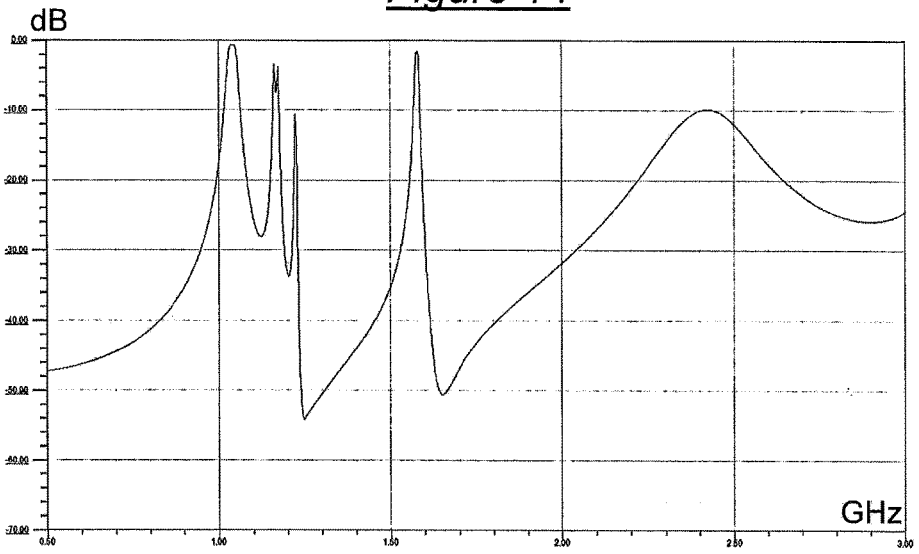
Figure 15:
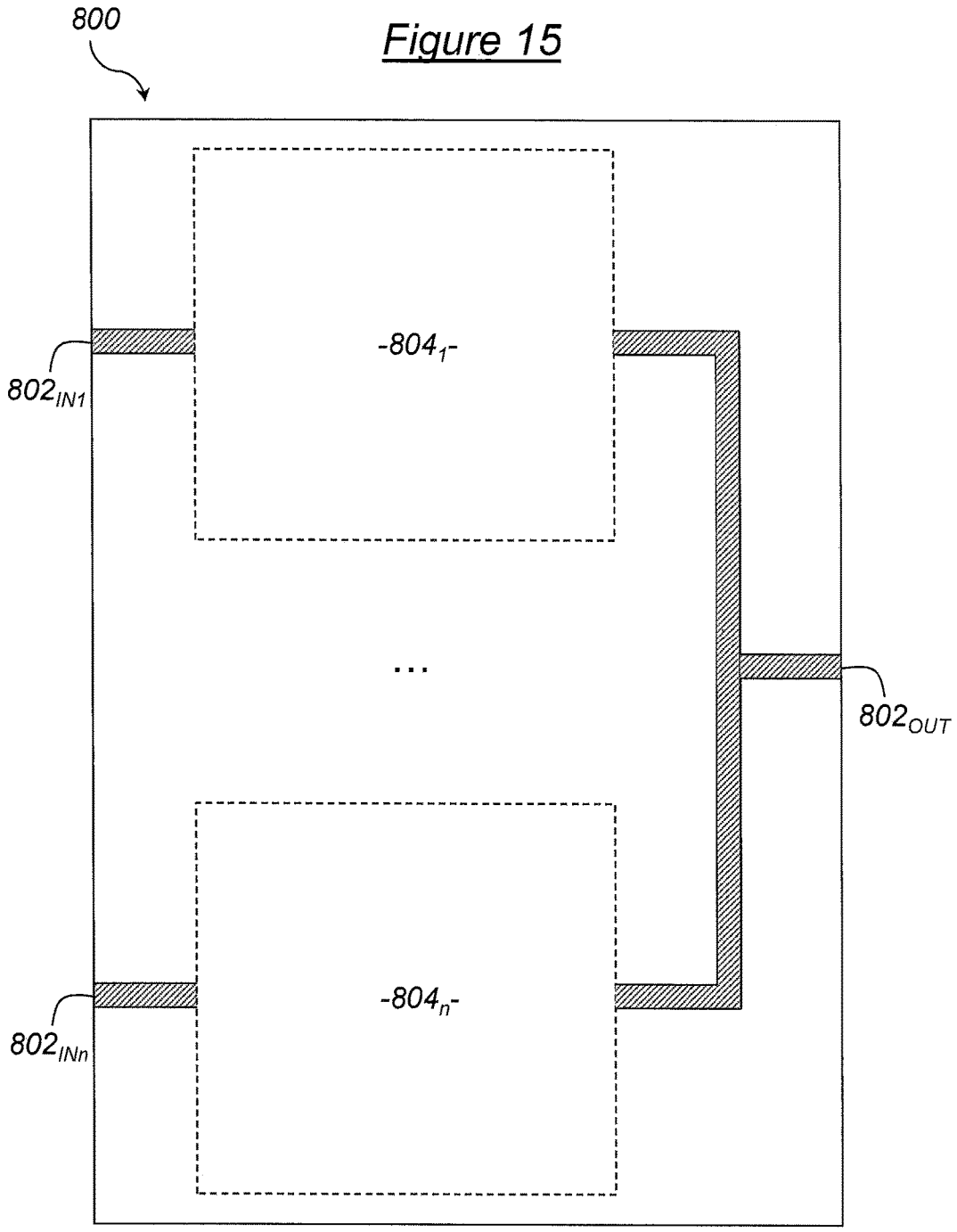

The invention will be better understood after reading the following description, which is provided for purposes of illustration only and with reference to the accompanying figures, wherein:

FIG. 1 schematically represents the general structure of a filter device according to a first preferred embodiment of the invention, FIG. 2 is a diagram illustrating the transfer function of the filter device in FIG. 1, FIG. 3 schematically represents the general structure of a filter device according to a second preferred embodiment of the invention, FIG. 4 is a diagram illustrating the transfer function of the filter device in FIG. 3, FIG. 5 schematically represents the general structure of a filter device according to a third preferred embodiment of the invention, FIG. 6 schematically represents the general structure of a filter device according to a fourth preferred embodiment of the invention, FIG. 7 schematically represents the general structure of a filter device according to a fifth preferred embodiment of the invention, FIG. 8 is a diagram illustrating the transfer function of the filter device in FIG. 7, FIG. 9 schematically represents the general structure of a filtering assembly according to a first preferred embodiment of the invention, FIG. 10 is a diagram illustrating the transfer function of the filtering assembly in FIG. 9, FIG. 11 schematically represents the general structure of a filtering assembly according to a second preferred embodiment of the invention, FIG. 12 is a diagram illustrating the transfer function of the filtering assembly in FIG. 11, FIG. 13 schematically represents the general structure of a filtering assembly according to a third preferred embodiment of the invention, FIG. 14 is a diagram illustrating the transfer function of the filtering assembly in FIG. 13, and FIG. 15 schematically represents the general structure of a filtering assembly according to a fourth preferred embodiment of the invention.

The filter device 100 schematically illustrated in FIG. 1 comprises a transmission line 102, for example a 50Ω line formed by an electrically conducting strip printed on a surface of an electrically insulating substrate 104. This conducting strip 102 has two ends $\mathbf{102}_{IN}$ and $\mathbf{102}_{OUT}$ respectively forming the two sole input and output connection ports of the filter device 100. In the embodiment illustrated in FIG. 1, the conducting strip 102 is rectilinear.

The filter device 100 further comprises a plurality of resonators $\mathbf{106}_1, \ldots, \mathbf{106}_M$, each resonator $\mathbf{106}_i$ ($1 \le i \le M$) comprising an electrically conducting strip printed on the same surface of the substrate 104 as the conducting strip of the transmission line 102. The conducting strip of each resonator $\mathbf{106}_i$ has a first end $\mathbf{108}_i$ connected to the transmission line 102 between the two connection ports $\mathbf{102}_{IN}$, $\mathbf{102}_{OUT}$ and a second end $\mathbf{110}_i$ that is free or connected to a ground so as to create an effective fundamental resonant wavelength specific to each resonator $\mathbf{106}_i$ on said surface of the substrate 104. In the embodiment illustrated in FIG. 1, the conducting strips of the resonators $\mathbf{106}_1, \ldots, \mathbf{106}_M$ are rectilinear, all of the same length L and parallel to each other so as to form a resonator comb. The resonators $\mathbf{106}_1, \ldots, \mathbf{106}_M$ are also perpendicular to the transmission line 102 and their second ends $\mathbf{110}_1, \ldots, \mathbf{110}_M$ are illustrated as free.

Given the fact that the second ends $\mathbf{110}_1, \ldots, \mathbf{110}_M$ are free, the resonators $\mathbf{106}_1, \ldots, \mathbf{106}_M$ all have the same effective fundamental resonant wavelength λ equal to four times their length L. Alternatively, if the second ends $\mathbf{110}_1, \ldots, \mathbf{110}_M$ were connected to the ground, the resonators $\mathbf{106}_1, \ldots, \mathbf{106}_M$ would all have the same effective fundamental resonant wavelength λ equal to two times their length L.

According to the invention, for each pair ($\mathbf{106}_i$, $\mathbf{106}_{i+1}$), where $1 \le i \le M-1$, of neighbouring resonators of the plurality of resonators $\mathbf{106}_1, \ldots, \mathbf{106}_M$, the distance noted $e_i$ between the first ends $\mathbf{108}_i$ and $\mathbf{108}_{1+1}$ of the two neighbouring resonators $\mathbf{106}_i$ and $\mathbf{106}_{i+1}$ of this pair is less than one tenth of the smallest effective fundamental resonant wavelength of the plurality of resonators which is, in this example where all of the resonators have the same length L, the aforementioned effective wavelength λ. These distances $e_1, \ldots, e_{M-1}$ can even be advantageously less than one tenth, or even less than one hundredth of the smallest effective fundamental resonant wavelength of the plurality of resonators $\mathbf{106}_1, \ldots, \mathbf{106}_M$. In the specific embodiment in FIG. 1, all of these distances $e_1, \ldots, e_{M-1}$ are equal and of the same order of magnitude as the width of each resonator.

A metamaterial structure made from microstrip technology is thus obtained, which has advantageous properties as previously stated. In particular, the hybridisation band gap property is caused by the interference phenomena between the resonators $\mathbf{106}_1, \ldots, \mathbf{106}_M$, which are very close to each other and respond in phase opposition to any incident electromagnetic field beyond their resonant frequency. Therefore, via destructive interferences beyond this frequency, any incident electromagnetic field is reflected, and the metamaterial structure constitutes a band-stop filter with interesting properties.

For the purposes of illustration, for a transmission line 102 at 50Ω, with a common resonator length L equal to 40 mm, a total width W of M=9 resonators equal to 20 mm, a distance $e=e_1=\ldots=e_{M+1}$ between neighbouring resonators of a little over 1 mm and a refractive index of the substrate 104 close to 1.45, the transfer function illustrated in FIG. 2 is obtained. This transfer function shows that a band-stop filter device 100 or in other words a −30 dB transmission band gap filter device has thus been designed, having good performance levels, the transmission band gap beginning immediately thereafter, in the frequency domain, the resonant frequency (around 1.3 GHz) corresponding to the aforementioned effective wavelength λ and extending up to 1.6 GHz. These good performance levels are also obtained for a filter device 100 that remains very compact occupying a minimum volume.

It should be noted that the filter structure illustrated in FIG. 1 is only one specific example of the filter device according to the invention. In a more general manner, the conducting strips forming the transmission line 102 and the resonators $\mathbf{106}_1, \ldots, \mathbf{106}_M$ are not necessarily rectilinear, the resonators are not necessarily parallel to each other or perpendicular to the transmission line and are not necessarily of the same length L. The distances $e_1, \ldots, e_{M-1}$ are also not necessarily equal. However, it is required that for each pair of neighbouring resonators of the plurality of resonators, the distance between the first ends of the two neighbouring resonators of this pair is less than one quarter, or even advantageously one tenth of the smallest effective fundamental resonant wavelength of the plurality of resonators, this smallest effective fundamental resonant wavelength being that of the resonator with the smallest length. This condition is required in order to obtain a metamaterial structure with advantageous properties. By modifying all of the other aforementioned structural parameters, the transfer function of the filter device can be adapted to suit the different target applications.

The filter device 200, schematically illustrated in FIG. 3 according to a second preferred embodiment of the invention, comprises a transmission line 202 with two ends $\mathbf{202}_{IN}$ and $\mathbf{202}_{OUT}$ printed on a substrate 204 and resonators $\mathbf{206}_1, \ldots, \mathbf{206}_M$ comprising first $\mathbf{208}_1, \ldots, \mathbf{208}_M$ and second $\mathbf{210}_1, \ldots, \mathbf{210}_M$ ends. It is identical to the filter device 100 with the exception that one $\mathbf{206}_i$ of its resonators $\mathbf{206}_1, \ldots, \mathbf{206}_M$ is shorter than the others. More precisely, the resonators $\mathbf{206}_1, \ldots, \mathbf{206}_M$ all have the same nominal length L, so as to produce the same nominal effective fundamental resonant wavelength λ, except for the short resonator $\mathbf{206}_i$, positioned somewhere in the metamaterial structure between the first resonator $\mathbf{206}_1$ and the last resonator $\mathbf{206}_M$ so as to produce a very small, singular resonant cavity in the plurality of resonators $\mathbf{206}_1, \ldots, \mathbf{206}_M$.

It should be noted that the distances $e_1, \ldots, e_{M-1}$ must remain less than one quarter, or even advantageously less than one tenth of the smallest effective fundamental resonant wavelength of the plurality of resonators, which is, in this example, the effective fundamental resonant wavelength of the short resonator $\mathbf{206}_i$.

Far from harming the metamaterial structure, the presence of the resonant cavity produced by the short resonator $\mathbf{206}_i$, enables certain waves to become trapped so as to create a resonance peak, wherein the position of this resonance peak can be adjusted in the transmission band gap of the filter device 200 by modifying the position and the size of the short resonator $\mathbf{206}_i$ in the plurality of resonators $\mathbf{206}_1, \ldots, \mathbf{206}_M$. This experiment shows that the resonance peak thus obtained is very narrow and therefore presents a high quality factor.

For the purposes of illustration, for a transmission line 202 at 50Ω, with a nominal length L equal to 40 mm, a total width W of M=9 resonators equal to 20 mm, a distance $e=e_1=\ldots=e_{M+1}$ between neighbouring resonators of a little over 1 mm, a short resonator measuring 30 mm positioned in the centre of the plurality of resonators and a refractive index of the substrate 204 close to 1.45, the transfer function illustrated in FIG. 4 is obtained. This transfer function shows that a band-stop filter device 200 or in other words a −30 dB transmission band gap filter device has thus been designed, having not only good performance levels, but also a high quality factor resonance in its band gap. The band gap at −30 dB, which extends from around 1.3 GHz to 1.7 GHz, has a resonance peak at a little under 1.6 GHz, the rejection being very sudden around this resonance, of 30 dB in a few tens of MHz. These good performance levels are also obtained for a filter device 200 that remains very compact occupying a minimum volume.

It is also possible to broaden the resonance peak within the transmission band gap by increasing the number of resonant cavities so as to couple these cavities to each other. This effect is obtained, for example, using the filter device 300 in FIG. 5.

The filter device 300 comprises a transmission line 302 with two ends $\mathbf{302}_{IN}$ and $\mathbf{302}_{OUT}$ printed on a substrate 304 and resonators $\mathbf{306}_1, \ldots, \mathbf{306}_M$ comprising first $\mathbf{308}_1, \ldots, \mathbf{308}_M$ and second $\mathbf{310}_1, \ldots, \mathbf{310}_M$ ends. It is similar to the filter devices 100 and 200 with the exception that several $\mathbf{306}_{i,1}, \ldots, \mathbf{306}_{i,N}$ of its resonators $\mathbf{306}_1, \ldots, \mathbf{306}_M$ are shorter than the others. More precisely, the resonators $\mathbf{306}_1, \ldots, \mathbf{306}_M$ all have the same nominal length L, so as to produce the same nominal effective fundamental resonant wavelength λ, except for the N short resonators $\mathbf{306}_{i,1}, \ldots, \mathbf{306}_{i,N}$, positioned in the metamaterial structure between the first resonator $\mathbf{306}_1$ and the last resonator $\mathbf{306}_M$ so as to produce N very small, coupled, singular resonant cavities in the plurality of resonators $\mathbf{306}_1, \ldots, \mathbf{306}_M$. Each short resonator is surrounded by two neighbouring resonators of nominal length.

Preferably, the N short resonators $\mathbf{306}_{i,1}, \ldots, \mathbf{306}_{i,N}$ are positioned according to a periodic pattern so as to produce N resonant cavities periodically distributed in said plurality of resonators. In the example provided in FIG. 5, a short resonator is placed at intervals of every three resonators. Each resulting resonant cavity is therefore separated from its neighbours by two resonators of nominal length and is not therefore directly coupled to its closest neighbours. This results in a filter device that does not allow any frequency to pass in the band gap, as stipulated for the device in FIG. 1, except on a frequency band centred on the resonant frequency of the cavities. The width of this frequency band can be modified by adapting the structural parameters of the filter device 300. This produces a type of filter with even more sudden frequency transitions (i.e. an increase in filter order) and that are easier to adjust.

Another effect resulting from the increase in the number of cavities in the metamaterial structure in FIG. 5 is the considerable slowing of the group velocity of the electric signals passing through the filter device, because a band of low velocity propagation modes is thus created.

Finally, it should be noted that the distances $e_1, \ldots, e_{M-1}$ must remain less than one quarter, or even advantageously less than one tenth of the smallest effective fundamental resonant wavelength of the plurality of resonators, which is, in this example, the effective fundamental resonant wavelength of the N short resonators $306_{i,1}, \ldots, 306_{i,N}$.

One alternative embodiment of FIG. 3 is illustrated in FIG. 6. The filter device 400 according to this alternative comprises a transmission line 402 with two ends $402_{IN}$ and $402_{OUT}$ printed on a substrate 404 and resonators $406_1, \ldots, 406_M$ comprising first $408_1, \ldots, 408_M$ and second $410_1, \ldots, 410_M$ ends. It is similar to the filter device 200 with the exception that the short resonator $206_i$ is replaced by a resonator $406_i$ of the same length as the others, however equipped with an electronic component 412 for adjusting its fundamental resonance equivalent electrical frequency. Thanks to this component, this frequency can be modulated and in particular be increased, without modifying the resonator length. The same effects as those of the filter device 200 can therefore also be obtained, in particular the same transfer function illustrated in FIG. 4, with a structure of resonators all having the same length, as in the filter device 100. The electronic component 412 is, for example, a PIN diode, a varicap diode, a varistor or a transistor.

Finally, it should be noted that the distances $e_1, \ldots, e_{M-1}$ must remain less than one quarter, or even advantageously less than one tenth of the smallest effective fundamental resonant wavelength of the plurality of resonators, which is, in this example, the effective fundamental resonant wavelength corresponding to the fundamental resonance equivalent electrical frequency of the resonator $406_i$.

Another alternative embodiment of FIG. 3 is illustrated in FIG. 7. The filter device 450 according to this other alternative comprises a transmission line 452 with two ends $452_{IN}$ and $452_{OUT}$ printed on a substrate 454 and resonators $456_1, \ldots, 456_M$ comprising first $458_1, \ldots, 458_M$ and second $460_1, \ldots, 460_M$ ends. It is similar to the filter device 200, with the exception that:

- the first end $458_1$, or . . . , or $458_M$ of each resonator $456_1$, or . . . , or $456_M$ is not directly connected to the transmission line 452, but is capacitively coupled to the latter via contactless proximity, and
- each resonator $456_1$, or . . . , or $456_M$ comprises two second free ends $460_1$, or . . . , or $460_M$ by being formed from a conducting strip divided into two along its medial portion according to the general shape of a tuning fork.

The short resonator $456_i$ remains shorter than the others. This resonator shape that is divided into two, referred to as fractal, can be generalized as an arborescent shape with multiple second ends for each resonator. It enables the length of each resonator to be shortened for the same effective resonant wavelength, at the expense of a larger lateral volume.

Finally, it should be noted that the distances $e_1, \ldots, e_{M-1}$, must remain less than one quarter, or even advantageously less than one tenth of the smallest effective fundamental resonant wavelength of the plurality of resonators, which is, in this example, the effective fundamental resonant wavelength corresponding to the fundamental resonant equivalent electrical frequency of the short resonator $456_i$.

For the purposes of illustration, for a transmission line 452 at 50Ω, with a nominal length L equal to 40 mm, a total width W of M=5 resonators equal to 20 mm, a distance $e=e_1=\ldots=e_{M+1}$ between neighbouring resonators of around 3 mm, a short resonator measuring 20 to 30 mm positioned in the centre of the plurality of resonators and a refractive index of the substrate 454 close to 1.45, the transfer function illustrated in FIG. 8 is obtained. This transfer function shows that a band-stop filter device 450 or in other words a −30 dB transmission band gap filter device has thus been designed, having not only good performance levels, but also a broadband resonance in its band gap. The band gap at −30 dB, which extends from around 1.45 GHz to 2.55 GHz, has a resonance peak at 1.9 GHz in a bandwidth at −30 dB, which extends from around 1.8 GHz to 2.4 GHz. These good performance levels are also obtained for a filter device 450 that remains very compact occupying a minimum volume.

Based on any one of the aforementioned filter devices 100, 200, 300, 400 and 450, or based on other possible alternative embodiments, a filtering assembly can be designed with at least one input connection port and at least one output connection port, comprising a plurality of filter devices according to the invention. All of the electrically conducting strips forming the transmission lines and the resonators of the filter devices of such a filtering assembly are printed on the same surface of the same substrate. Moreover, the filter devices are coupled to each other in series and/or in parallel according to layouts that can vary greatly. A filtering assembly can therefore be designed to reach ambitious objectives in terms of bandwidth, bandwidth loss and rejection level around this bandwidth.

According to a first family of possible layouts, the filter devices are coupled to each other in series, such that the filtering assembly only comprises one input connection port and one output connection port, the input connection port of the first filter device of the series forming the input connection port of the filtering assembly and the output connection port of the last filter device of the series forming the output connection port of the filtering assembly.

A first embodiment of a filtering assembly according to the invention and according to this first family of layouts is illustrated in FIG. 9.

The filtering assembly 500 with two connection ports $502_{IN}$ and $502_{OUT}$ illustrated in this figure comprises two filter devices 504, 506 of the same type as the filter device 200, i.e. with resonators all having the same nominal length except one. The input connection port $502_{IN}$ corresponds to the input connection port of the first filter device 504 and the output connection port $502_{OUT}$ corresponds to the output connection port of the second and last filter device 506.

The two transmission lines of the two filter devices 504 and 506 are in the extension of each other and the output connection port of the transmission line of the first filter device 504 is coupled to the input connection port of the transmission line of the second filter device 506 using a printed capacitive element 508. The latter is formed from two electrically conducting strips perpendicular to the transmission lines of the two coupled filter devices 504 and 506. It therefore maintains the two filter devices 504 and 506 at a certain distance from each other while coupling them to each other.

For the purposes of illustration, with experimentation structural parameters similar to those of the filter device 200, the transfer function illustrated in FIG. 10 is obtained. This transfer function shows that a filtering assembly 500 has been designed, with improved band-stop and resonant band properties in the band gap. In particular a bandwidth at −30 dB of around 100 MHz between 1.5 and 1.6 GHz in the band gap and a rejection of 40 dB in a few tens of MHz around this bandwidth are achieved, the losses at the resonance peak being less than 3 dB.

A second embodiment of a filtering assembly according to the invention and according to the first family of layouts is illustrated in FIG. 11.

The filtering assembly 600 with two connection ports $602_{IN}$ and $602_{OUT}$ illustrated in this figure comprises two filter devices 604, 606 of the same type as the filter device 200, i.e. with resonators all having the same nominal length except one (the resonant cavity however not being positioned in the centre of the plurality of resonators). These two filter devices 604 and 606 are positioned in axial symmetry with each other along an axis perpendicular to the transmission lines. The input connection port $602_{IN}$ corresponds to the input connection port of the first filter device 604 and the output connection port $602_{OUT}$ corresponds to the output connection port of the second and last filter device 606.

The two transmission lines of the two filter devices 604 and 606 are in the extension of each other and the output connection port of the transmission line of the first filter device 604 is electromagnetically coupled to the input connection port of the transmission line of the second filter device 606. For this purpose, the two coupled ports are moved closer to each other and the coupling takes place directly without the use of a specific element. This coupling varies as a function of the distance separating the two filter devices 604 and 606.

For the purposes of illustration, with experimentation structural parameters similar to those of the filter device 200, the transfer function illustrated in FIG. 12 is obtained. This transfer function shows that a filtering assembly 600 has been designed, with improved band-stop and resonant band properties in the band gap. In particular a bandwidth at −30 dB of around 50 MHz in the band gap and a rejection of 40 dB in a few tens of MHz around this bandwidth are achieved, the losses at the resonance peak being less than 3 dB.

A third embodiment of a filtering assembly according to the invention and according to the first family of layouts is illustrated in FIG. 13.

The filtering assembly 700 with two connection ports $702_{IN}$ and $702_{OUT}$ illustrated in this figure comprises two filter devices 704, 706 of the same type as the filter device 200, i.e. with resonators all having the same nominal length except one (the resonant cavity however not being positioned in the centre of the plurality of resonators). These two filter devices 704 and 706 are positioned in central symmetry with each other according to a point of the substrate on which they are printed. The input connection port $702_{IN}$ corresponds to the input connection port of the first filter device 704 and the output connection port $702_{OUT}$ corresponds to the output connection port of the second and last filter device 706.

Given the central symmetry arrangement, the two transmission lines of the two filter devices 704 and 706 are parallel without being in the extension of each other. The electromagnetic coupling of the two filter devices 704 and 706 takes place along two of their resonators arranged close to each other and side-by-side, one connected to the output connection port of the first filter device 704, the other connected to the input connection port of the second filter device 706. Coupling takes place directly without the use of a specific element. This coupling varies as a function of the distance separating the two side-by-side resonators.

For the purposes of illustration, with experimentation structural parameters similar to those of the filter device 200, the transfer function illustrated in FIG. 14 is obtained. This transfer function, very similar to that in FIG. 10, shows that a filtering assembly 700 has been designed, with improved band-stop and resonant band properties in the band gap.

According to a second family of possible layouts, the aforementioned filter devices 100, 200, 300, 400 and 450 can be coupled to each other in parallel such that the filtering assembly comprises several input connection ports or several output connection ports.

A fourth embodiment of a filtering assembly according to the invention and according to this second family of layouts is illustrated in FIG. 15.

The filtering assembly 800 with n input connection ports $802_{IN1}, \ldots, 802_{INn}$ and one output connection port $802_{OUT}$ illustrated in this figure comprises n filters $804_1, \ldots, 804_n$ that can each be of the same type as any one of the filter devices 100, 200, 300, 400 and 450 or any other filter device. The input connection port $802_{IN1}$ corresponds to the input connection port of the first filter $804_1, \ldots$, the input connection port $802_{INn}$ corresponds to the input connection port of the last filter $804_n$ and the output connection port $802_{OUT}$ corresponds to the parallel interconnection of the n output connection ports of the n filters $804_1, \ldots, 804_n$.

In particular, if the n filters $804_1, \ldots, 804_n$ have resonance peaks or bandwidths in their band gaps, a multiplexer can be designed (a duplexer if n=2). For example if a signal, the spectrum of which is included in the band gap of each filter $804_1, \ldots, 804_n$, is provided at the inputs $802_{IN1}, \ldots, 802_{INn}$ of the filtering assembly 800, only the portion of the spectrum corresponding to the resonance peak or the bandwidth of the first filter $804_1$ is transmitted by said first filter $804_1$ at the output $802_{OUT}, \ldots$, and only the portion of the spectrum corresponding to the resonance peak or bandwidth of the last filter $804_1$ is transmitted by said last filter $804_1$ at the output $802_{OUT}$, so as to obtain an output signal that is multiplexed according to the different resonance peaks or bandwidths of the n filters $804_1, \ldots, 804_n$.

It should be noted that the filtering assembly 800 is passive and therefore reversible. It can therefore be viewed and used as a filtering assembly with one input connection port $802_{OUT}$ and n output connection ports $802_{IN1}, \ldots, 802_{INn}$. By injecting therein a signal with a spectrum included in the band gap of each filter $804_1, \ldots, 804_n$, the n portions of the signal are observed at the outputs $802_{IN1}, \ldots, 802_{INn}$, said portions respectively corresponding to the n resonance peaks or bandwidths of the n filters $804_1, \ldots, 804_n$.

It is also possible to generalize the layout of the filtering assembly 800 by considering that filtering assemblies with filter devices coupled in series, for example the filtering assemblies 500, 600 and 700, can also constitute all or part of the filters $804_1, \ldots, 804_n$ coupled in parallel.

Conversely, a filtering assembly can be designed by the series coupling of the filtering assemblies of parallel-coupled filter devices.

It clearly appears that a filter device or filtering assembly such as any one of those described hereinabove, can be used to provide a high-performance filter occupying a minimum volume, thanks to a metamaterial structure obtained by moving a plurality of resonators closer together such that the distances between neighbouring resonators is always less than one quarter, or advantageously less than one tenth of the smallest effective fundamental wavelength of the plurality of resonators.

It should also be noted that the invention is not limited to the embodiments described hereinabove.

In particular, with regard to the filtering assemblies presented with reference to FIGS. 9, 11 and 13, it should be noted that the number of filter devices coupled in series can be increased as needed.

More generally, all of the layouts of coupled filter devices can be considered, in particular cascade, star or other layouts.

One of ordinary skill in the art will realize that various modifications can be provided to the embodiments described hereinabove, using the information disclosed herein. In the following claims, the terms used must not be interpreted as limiting the claims to the embodiments presented in this description, however must be interpreted to include all equivalents that the claims intend to cover via their formation and the prediction of which is within reach of one of ordinary skill in the art when applying his/her general knowledge to the implementation of the information disclosed herein.

The invention claimed is:

1. A filter device with an electrically conducting strip structure, comprising:

a transmission line formed by an electrically conducting strip printed on a surface of an electrically insulating substrate, said conducting strip having two ends respectively forming the two sole input and output connection ports of the filter device, a plurality of resonators, each resonator comprising an electrically conducting strip printed on said surface of the substrate, wherein:

the conducting strip of each resonator has a first end coupled to the transmission line between the two connection ports and at least one second end that is free or connected to a ground so as to create an effective fundamental resonant wavelength specific to each resonator on said surface of the substrate, and for each pair of neighbouring resonators of the plurality of resonators, a distance between the first ends of two neighbouring resonators of the pair is less than one tenth of a smallest effective fundamental resonant wavelength of the plurality of resonators on said surface of the substrate.

2. The filter device with an electrically conducting strip structure according to claim 1, wherein the conducting strips forming the transmission line and the resonators are rectilinear, the resonators also being parallel to each other so as to form a resonator comb.

3. The filter device with an electrically conducting strip structure according to claim 2, wherein the resonators are perpendicular to the transmission line.

4. The filter device with an electrically conducting strip structure according to claim 1, wherein the resonators all have a same nominal length, so as to produce a same nominal effective fundamental resonant wavelength, with the exception of at least one short resonator, each short resonator being surrounded by two neighbouring resonators of nominal length and having a length that is less than the nominal length so as to produce at least one resonant cavity in said plurality of resonators.

5. The filter device with an electrically conducting strip structure according to claim 4, wherein the resonators all have a nominal length except for a single short resonator so as to produce a single resonant cavity in said plurality of resonators.

6. The filter device with an electrically conducting strip structure according to claim 4, wherein the resonators all have a nominal length except for N short resonators, where $N \geq 2$, positioned according to a periodic pattern so as to produce N resonant cavities periodically distributed in said plurality of resonators.

7. The filter device with an electrically conducting strip structure according to claim 1, wherein at least one resonator is equipped with an electronic component for adjusting its fundamental resonance equivalent electrical frequency.

8. The filter device with an electrically conducting strip structure according to claim 7, wherein the electronic adjustment component comprises one of the elements of the set consisting of a PIN diode, a varicap diode, a varistor and a transistor.

9. A filtering assembly with at least one input connection port and at least one output connection port, comprising a plurality of filter devices according to claim 1, wherein:

the electrically conducting strips forming the transmission lines and the resonators of the filter devices are printed on the same surface of the same substrate, the filter devices are coupled to each other in series and/or in parallel.

10. The filtering assembly according to claim 9, comprising a single input connection port and a single output connection port, wherein the filter devices are coupled to each other via a series connection such that the input connection port of a first filter device of the series forms the input connection port of the filtering assembly and the output connection port of a last filter device of the series forms the output connection port of the filtering assembly.

* * * * *